US010088165B2

(12) United States Patent
Nguyen et al.

(10) Patent No.: US 10,088,165 B2
(45) Date of Patent: Oct. 2, 2018

(54) SYSTEM AND METHOD FOR TUNING RESONATORS

(71) Applicant: General Electric Company, Schenectady, NY (US)

(72) Inventors: Quoc Hoai Nguyen, Houston, TX (US); Kwanwoo Kim, Cincinnati, OH (US); Whitney Epperson, Houston, TX (US); Patrick Edward Pastecki, Houston, TX (US); Mark Anthony Mueller, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 272 days.

(21) Appl. No.: 14/680,995

(22) Filed: Apr. 7, 2015

(65) Prior Publication Data

US 2016/0298847 A1 Oct. 13, 2016

(51) Int. Cl.

| | |
|---|---|
| ***F23M 20/00*** | (2014.01) |
| ***F23R 3/28*** | (2006.01) |
| ***F01N 1/02*** | (2006.01) |
| ***F23R 3/00*** | (2006.01) |

(52) U.S. Cl.

CPC ..... *F23R 3/28* (2013.01); *F01N 1/02* (2013.01); *F23M 20/005* (2015.01); *F23R 3/002* (2013.01); *F23R 2900/00013* (2013.01); *F23R 2900/00014* (2013.01)

(58) Field of Classification Search

CPC .. F23R 3/28; F23R 3/002; F23R 2900/00013; F23R 2900/0014; F23M 20/005; F01N 1/02; F02C 5/10

See application file for complete search history.

(56) References Cited

U.S. PATENT DOCUMENTS

| | | | | |
|---|---|---|---|---|
| 2,072,826 | A | 3/1937 | Rey | |
| 5,943,866 | A | 8/1999 | Lovett et al. | |
| 6,164,055 | A | 12/2000 | Lovett et al. | |
| 6,464,489 | B1 * | 10/2002 | Gutmark | F02B 51/06 431/1 |
| 6,530,221 | B1 | 3/2003 | Sattinger et al. | |
| 6,625,569 | B2 | 9/2003 | James et al. | |

(Continued)

FOREIGN PATENT DOCUMENTS

| | | |
|---|---|---|
| EP | 1319153 | 6/2003 |
| EP | 1605205 | 12/2005 |

(Continued)

OTHER PUBLICATIONS

Richards, Geo et al., "Effect of Fuel System Impedance Mismatch on Combustion Dynamics," ASME Turbo Expo 2005: Power for Land, Sea, and Air, vol. 2, Paper No. GT2005-68386, Reno, Nevada, Jun. 6-9, 2005, 11 pgs.

(Continued)

*Primary Examiner* — Steven Sutherland
(74) *Attorney, Agent, or Firm* — Fletcher Yoder, P.C.

(57) ABSTRACT

A system includes a combustor having a combustion chamber and a combustor supply passage configured to supply a fluid flow into the combustion chamber. The system also includes a resonator configured to receive at least a portion of the fluid flow. The resonator comprises a frequency adjuster configured to change an attenuation frequency of the resonator.

12 Claims, 7 Drawing Sheets

(56) References Cited

U.S. PATENT DOCUMENTS

| | | | | |
|---|---|---|---|---|
| 6,820,431 | B2 | 11/2004 | McManus et al. | |
| 7,194,862 | B2 | 3/2007 | Sattinger | |
| 7,278,266 | B2 | 10/2007 | Taware et al. | |
| 7,337,057 | B2 | 2/2008 | Norman et al. | |
| 7,451,601 | B2 | 11/2008 | Taware et al. | |
| 7,503,177 | B2 | 3/2009 | Bland et al. | |
| 7,523,614 | B2 | 4/2009 | Tanimura et al. | |
| 7,549,506 | B2 | 6/2009 | Sattinger | |
| 7,578,130 | B1 | 8/2009 | Kraemer et al. | |
| 7,620,461 | B2 | 11/2009 | Frederick, II et al. | |
| 7,693,147 | B2 | 4/2010 | Williams et al. | |
| 7,739,999 | B2 | 6/2010 | Kang et al. | |
| 7,743,599 | B2 | 6/2010 | Taware et al. | |
| 7,805,922 | B2 | 10/2010 | Bland | |
| 7,908,072 | B2 | 3/2011 | Tonno et al. | |
| 7,997,083 | B2 | 8/2011 | Meadows et al. | |
| 8,112,216 | B2 | 2/2012 | Davis, Jr. et al. | |
| 8,127,546 | B2 | 3/2012 | Park | |
| 8,322,140 | B2 | 12/2012 | Kim et al. | |
| 8,966,909 | B2 | 3/2015 | Crothers et al. | |
| 2002/0100281 | A1 | 8/2002 | Hellat et al. | |
| 2005/0106519 | A1* | 5/2005 | Flohr | F23R 3/14 431/114 |
| 2005/0278108 | A1 | 12/2005 | Norman et al. | |
| 2006/0041368 | A1 | 2/2006 | Williams et al. | |
| 2006/0042261 | A1 | 3/2006 | Taware et al. | |
| 2006/0254279 | A1 | 11/2006 | Taware et al. | |
| 2007/0180831 | A1 | 8/2007 | Bland | |
| 2008/0010966 | A1 | 1/2008 | Taware et al. | |
| 2008/0216481 | A1* | 9/2008 | Pollarolo | F23R 3/50 60/725 |
| 2009/0005951 | A1 | 1/2009 | Frederick et al. | |
| 2009/0005952 | A1 | 1/2009 | Tonno et al. | |
| 2009/0063003 | A1 | 3/2009 | Meadows et al. | |
| 2010/0170254 | A1 | 7/2010 | Venkataraman et al. | |
| 2010/0192578 | A1 | 8/2010 | Singh et al. | |
| 2010/0313568 | A1 | 12/2010 | Davis, Jr. et al. | |
| 2011/0048021 | A1 | 3/2011 | Slobodyanskiy et al. | |
| 2011/0072826 | A1 | 3/2011 | Narra et al. | |
| 2011/0179795 | A1 | 6/2011 | Johnson et al. | |
| 2011/0162370 | A1 | 7/2011 | Kim et al. | |
| 2012/0006029 | A1 | 1/2012 | Bilbao et al. | |
| 2012/0137690 | A1* | 6/2012 | Sardeshmukh | F23R 3/002 60/725 |
| 2012/0204534 | A1 | 8/2012 | Kenyon et al. | |
| 2013/0000312 | A1 | 1/2013 | Kodukulla et al. | |
| 2013/0014514 | A1 | 1/2013 | Romig et al. | |
| 2013/0269353 | A1 | 10/2013 | Bulat | |
| 2014/0053528 | A1 | 2/2014 | Crothers et al. | |
| 2014/0060063 | A1 | 3/2014 | Boardman et al. | |
| 2014/0109587 | A1 | 4/2014 | Crothers et al. | |
| 2014/0137561 | A1 | 5/2014 | Crothers et al. | |
| 2014/0238026 | A1 | 8/2014 | Boardman et al. | |
| 2014/0238033 | A1 | 8/2014 | Crothers et al. | |
| 2014/0238041 | A1 | 8/2014 | Crothers et al. | |
| 2014/0260299 | A1 | 9/2014 | Boardman et al. | |
| 2015/0047357 | A1* | 2/2015 | Schuermans | F23R 3/002 60/725 |

FOREIGN PATENT DOCUMENTS

| | | |
|---|---|---|
| EP | 1632718 | 3/2006 |
| EP | 2031192 | 3/2009 |
| EP | 2474784 | 7/2012 |
| WO | 0225174 | 3/2002 |
| WO | 2008153736 | 12/2008 |

OTHER PUBLICATIONS

Spoor et al., "Mode-locking of acoustic resonators and its application to vibration cancellation in acoustic heat engines," Condensed Matter and Thermal Physics Group, Los Alamos National Laboratory, Los Alamos, New Mexico, Feb. 10, 1999, 10 pgs.
U.S. Appl. No. 14/171,001, filed Feb. 3, 2014, Crothers et al.
U.S. Appl. No. 14/192,687, filed Feb. 27, 2014, Crothers et al.
U.S. Appl. No. 14/207,041, filed Mar. 12, 2014, Crothers et al.
U.S. Appl. No. 14/276,700, filed May 13, 2014, Crothers et al.
U.S. Appl. No. 14/249,158, filed Apr. 9, 2014, Ziminsky et al.
U.S. Appl. No. 14/248,194, filed Apr. 8, 2014, Stevenson et al.
U.S. Appl. No. 14/288,875, filed May 28, 2014, Crothers et al.
U.S. Appl. No. 14/288,974, filed May 28, 2014, Crothers et al.
U.S. Appl. No. 14/316,616, filed Jun. 26, 2014, Crothers et al.
U.S. Appl. No. 14/659,399, filed Mar. 16, 2015, DiCintio et al.
U.S. Appl. No. 14/048,252, filed Oct. 8, 2013, Crothers et al.
U.S. Appl. No. 14/170,702, filed Feb. 3, 2014, Day et al.
U.S. Appl. No. 14/170,710, filed Feb. 3, 2014, Carrell Jr. et al.
U.S. Appl. No. 14/170,716, filed Feb. 3, 2014, Crothers et al.
U.S. Appl. No. 14/170,729, filed Feb. 3, 2014, Crothers et al.
U.S. Appl. No. 14/170,738, filed Feb. 3, 2014, Crothers et al.
U.S. Appl. No. 14/154,925, filed Jan. 14, 2014, Aphale et al.
European Search Report and Opinion issued in connection with corresponding EP Application No. 6163676.6 dated Jan. 13, 2017.

* cited by examiner

SYSTEM AND METHOD FOR TUNING RESONATORS

BACKGROUND

The subject matter disclosed herein relates to gas turbine systems, and more particularly, to a system and method for attenuating resonance.

Gas turbine systems generally include a gas turbine engine having a compressor section, a combustor section, and a turbine section. The combustor section may include one or more combustors (e.g., combustion cans), which receive and combust a fuel with an oxidant (e.g., air) in a combustion chamber of each combustor. As combustion occurs in each combustor, hot combustion gases flow into and drive one or more turbine stages in the turbine section. Unfortunately, gas turbine systems may be susceptible to resonant behavior due to a variety of drivers, such as a resonant frequency of the oxidant, fuel, or other fluids supplied to the combustors. Over time, the resonant frequencies may change in the gas turbine system.

BRIEF DESCRIPTION

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, the disclosure may encompass a variety of forms that may be similar to or different from the embodiments set forth below.

In a first embodiment, a system includes a combustor having a combustion chamber and a combustor supply passage configured to supply a fluid flow into the combustion chamber. The system also includes a resonator configured to receive at least a portion of the fluid flow. The resonator comprises a frequency adjuster configured to change an attenuation frequency of the resonator.

In a second embodiment, a system includes a resonator configured to receive at least a portion of a fluid flow being supplied to a combustion chamber of a combustor. The resonator includes a frequency adjuster configured to change an attenuation frequency of the resonator. The system also includes a controller comprising a memory operatively coupled to a processor configured to store data and instructions. The controller is configured to transmit instructions to the frequency adjuster to change the attenuation frequency of the resonator.

In a third embodiment, a method includes adjusting an attenuation frequency of a resonator coupled to a combustor supply passage configured to supply a fluid flow into a combustion chamber of a combustor. The resonator is configured to receive at least a portion of the fluid flow.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
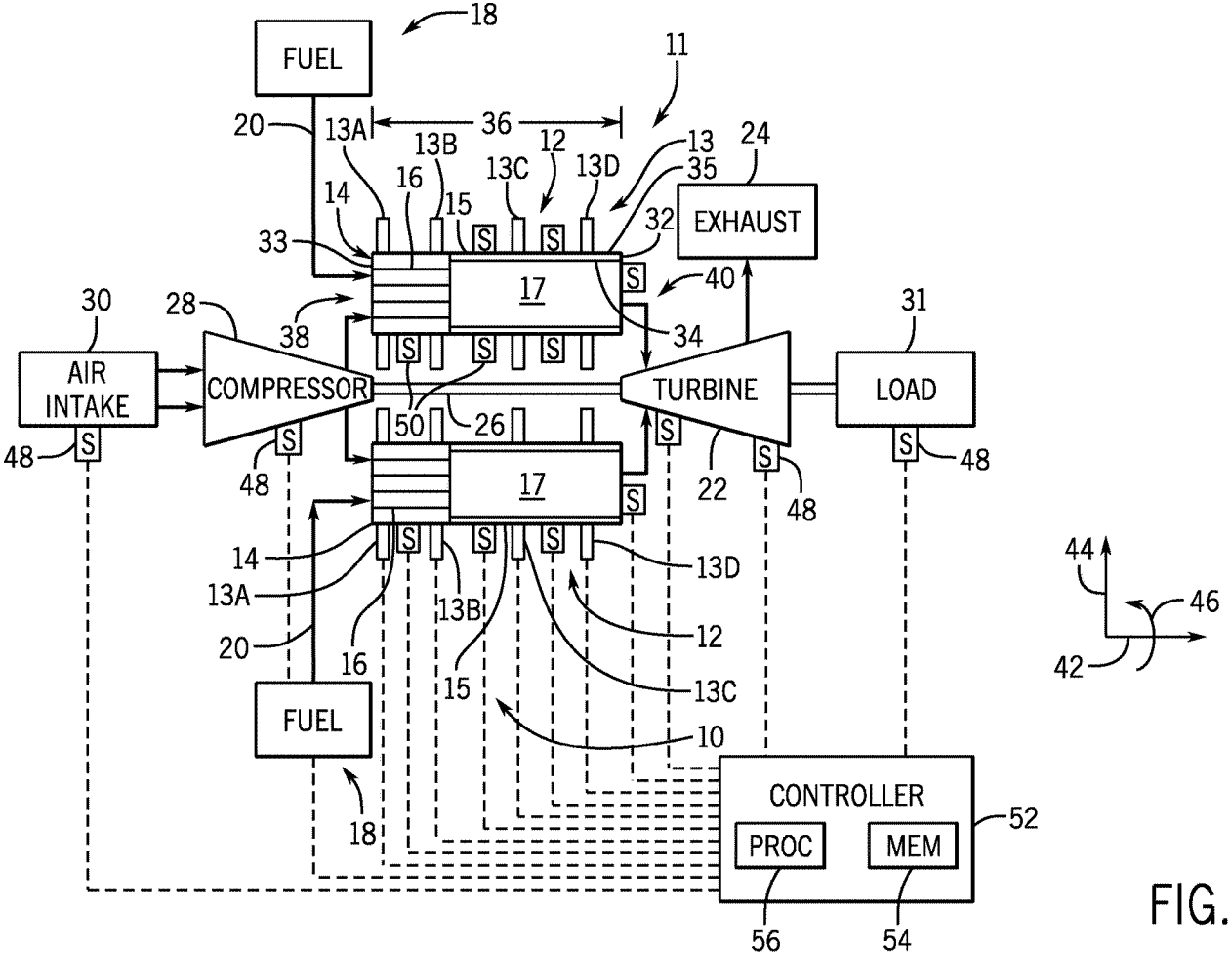
FIG. 1 is a schematic diagram of an embodiment of a gas turbine system having a resonance attenuation system with a plurality of resonators (e.g., adjustable resonators)

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure are directed toward a system and method for adjusting combustion conditions by adjustably attenuating resonance of a flowing fluid (e.g., fuel, oxidant such as air, steam, inert gas such as nitrogen, combustion gases, or any combination thereof), thereby helping to increase flammability, improve stability of a flame, reduce emissions, and control combustion dynamics. For example, a gas turbine system may include a resonance attenuation system associated with one or more combustors, such as an annular combustor or a plurality of can-annular combustors circumferentially spaced about the rotational axis. The resonance attenuation system may include one or more resonators (e.g., adjustable resonators) associated with each combustor. For example, the resonator may be configured to attenuate or damp resonant frequencies associated with one or more fluid flows (e.g., gas and/or liquid flows), such as fluid flows upstream from, within, or downstream from the combustors. The fluid flows may include supplies of fuel (e.g., liquid and/or gas fuel), oxidant (e.g., oxygen, air, oxygen-rich air, oxygen-reduced air, or any other oxygen-containing mixture), steam, inert gas (e.g., nitrogen), recirculated exhaust gas, or any combination thereof. The fluid flows also may include combustion gases. However, in the following discussion and illustrated embodiments, the resonators are presented in context of oxidant flows (e.g., air flows) upstream, at, or within the combustors. For example, the resonators may be mounted in fluid communication with flows (e.g., oxidant flows)

between a liner and flow sleeve of the combustor, through a head end chamber of the combustor, or any combination thereof. The resonators redirect at least a portion of the fluid flow along an attenuation length of the resonator to attenuate resonance frequencies and induce dampening. In certain embodiments, the attenuation length corresponds to a particularly selected frequency.

The resonators may include adjustment mechanisms (e.g., frequency adjusters) configured to adjust one or more parameters of the resonators before, during, and/or after operation of the gas turbine system, thereby tailoring the resonators to resonant frequencies that may change with time and use of the gas turbine system. In certain embodiments, the resonators include quarter wavelength tube (QWT) resonators with an adjustable length. In other embodiments, the resonators may include other types of resonators with adjustments to vary the attenuation frequency of the resonators. For example, the adjustment mechanisms may enable adjustments to the volume (e.g., length) and thus attenuation frequency of the resonators during manufacturing, during operational testing and tuning, during normal operation, during downtime, during servicing or maintenance, or at any other suitable time. For example, the adjustment mechanisms may include manual adjusters and/or powered adjusters, such as automatic or semi-automatic adjusters. The powered adjusters also may be coupled to a control system and a monitoring system, thereby helping to enable automatic adjustments in response to changes in resonant frequencies in the gas turbine system. For example, the adjustment mechanisms may adjust the attenuation lengths based on signals received from sensors monitoring various operating conditions of the combustors. As a result, tuning of the resonators may stabilize emissions, reduce combustion dynamics, and/or stabilize combustion conditions.

With the foregoing in mind, FIG. 1 is a schematic diagram of an embodiment of a gas turbine system 10 having a resonance attenuation system 11 (e.g., an adjustable resonance attenuation system) associated with one or more combustors 12 of a combustor section. As discussed below, the resonance attenuation system 11 may include a plurality of resonators 13 (e.g., frequency adjustable resonators) directly coupled to the combustors 12, supply passages leading to the combustors 12, or any suitable location. For example, the resonance attenuation system 11 may include resonators 13 coupled to a head end section 14 and/or a combustion section 15 of each combustor 12, such as along an oxidant (e.g., air) flow path along the head end section 14 and/or combustion section 15. In certain embodiments, one or more resonators 13 may be coupled to the oxidant flow path upstream of fuel nozzles 16 mounted in the head end section 14 of the combustor 12. However, in certain embodiments, one or more resonators 13 may be coupled to the fuel nozzles 16 in the head end section 14 of the combustor 12, one or more resonators 13 may be fluidly coupled to a combustion chamber 17 inside of the combustion section 15 downstream from the fuel nozzles 16, or any combination thereof.

The combustor 12 may represent a single annular combustor, which extends circumferentially around a rotational axis of the turbine system 10. By further example, the combustor 12 may represent a plurality of combustors (e.g., 2, 3, 4, 5, 6, 7, 8, 9, 10, or more) spaced circumferentially about the rotational axis of the turbine system 10. In certain embodiments, any number of combustors 12 (e.g., 1 to 20 or more) may be provided in the turbine system 10. The resonators 13 of the resonance attenuation system 11 may be coupled to each combustor 12 in a uniform arrangement or a non-uniform arrangement, and the arrangement of resonators 13 may be uniform or non-uniform from one combustor 12 to another. For example, the number, spacing, and attenuation frequency of the resonators 12 may be the same or different from one combustor 12 to another.

The turbine system 10 may use liquid or gaseous fuel, such as natural gas and/or a synthetic gas, to drive the turbine system 10. In the illustrated embodiment, one or more fuel nozzles 16 (e.g., primary fuel nozzles, one or more quaternary injectors or pegs, and/or one or more late lean injectors) intake a supply of fuel 18 (e.g., a liquid fuel supply, a gaseous fuel supply, a liquid/gas mixture fuel supply). Each of the plurality of combustors 12 includes one or more fuel nozzles 16 (e.g., 1, 2, 3, 4, 5, 6, or more). Examples of the fuel 18 include, but are not limited to, hydrocarbon based liquid fuels, such as diesel fuel, jet fuel, gasoline, naphtha, fuel oil, liquefied petroleum gas, and so forth. Moreover, the fuel 18 may include a hydrocarbon based gaseous fuel, such as natural gas, synthetic gas, or the like. In the illustrated embodiment, the turbine system 10 may route the fuel 18 along a fuel path 20 upstream of the fuel nozzles 16. In certain embodiments, the fuel nozzles 16 may include premix fuel nozzles and/or diffusion flame fuel nozzles. For example, the fuel nozzles 16 may premix the fuel 18 with oxidant (e.g., air) to generate a premix flame and/or separately flow the fuel 18 and oxidant into the combustors 12 to generate a diffusion flame.

The fuel 18 combusts with oxidant (e.g., air) in the combustion chamber 17 within each of the combustors 12, thereby creating hot pressurized exhaust gases. The combustors 12 direct the exhaust gases through a turbine or turbine section 22 toward an exhaust outlet 24. The turbine section 22 may include one or more turbine stages (e.g., 1, 2, 3, 4, 5, 6, 7, 8, 9, 10, or more), each having a plurality of turbine blades coupled to a turbine rotor and shaft 26. As the exhaust gases pass through the turbine 22, the gases force the turbine blades to rotate the shaft 26 along a rotational axis of the turbine system 10. As illustrated, the shaft 26 is connected to various components of the turbine system 10, including a compressor or compressor section 28. The compressor section 28 may include one or more compressor stages (e.g., 1, 2, 3, 4, 5, 6, 7, 8, 9, 10, or more), each having a plurality of compressor blades coupled to a compressor rotor and shaft, e.g., shaft 26. As the shaft 26 rotates, the blades within the compressor 28 also rotate, thereby compressing oxidant (e.g., air) from an oxidant intake (e.g., air intake 30) through the compressor 28 and into the fuel nozzles 16 and/or combustors 12. The shaft 26 may also be connected to a load 31, which may be a vehicle or a stationary load, such as an electrical generator in a power plant or a propeller on an aircraft, for example. The load 31 may include any suitable device capable of being powered by the rotational output of the turbine system 10.

In the following discussion, reference may be made to an axial direction or axis 42 (e.g., a longitudinal axis) of the combustor 12, a radial direction or axis 44 that extends radially relative to the axis 42 of the combustor 12, and a circumferential direction or axis 46 that extends circumferentially about the axis 42 of the combustor 12. As discussed in detail below, in certain embodiments, the turbine system 10 includes adjustable resonators 13 (e.g., quarter wavelength tube resonators) positioned on the combustors 12 at various locations, such as indicated by resonators 13A, 13B, 13C, and 13D. For example, the resonators 13 may be coupled to each combustor 12 in fluid communication with a flow path 32 along the combustor 12 (e.g., external to the combustion chamber 17), a head end chamber 33 in the head end section 14, or a combination thereof. For example, the flow path 32 may be in fluid communication with the head end chamber 33 and a compressor discharge chamber from the compressor 28, thereby routing a compressed gas flow (e.g., compressed oxidant such as air) through the flow path 32 along the combustor (e.g., for cooling purposes), through the head end chamber 33, and into the combustion chamber 17 (e.g., through the fuel nozzles 16) for purposes of combustion. In certain embodiments, the fluid flow through the flow path 32 and the head end chamber 33 (e.g., upstream of the fuel nozzles 16) may include or exclude any one or more of an oxidant (e.g., air, oxygen, oxygen-enriched air, oxygen-reduced air, etc.), exhaust gas recirculation (EGR) gas, steam, inert gas (e.g., nitrogen), and/or some amount of fuel (e.g., secondary fuel injection upstream of fuel nozzles 16). In certain embodiments, the flow path 32 may be disposed circumferentially about at least one wall defining a boundary of the combustor 12, such as a first wall 34 (e.g., a combustion liner) disposed circumferentially about the combustion chamber 17 and/or at least a portion of the head end chamber 33. The flow path 32 also may be bounded by a second wall 35 (e.g., a flow sleeve) disposed circumferentially about the first wall 34. The second wall 35 also may be disposed circumferentially about the head end chamber 33 of the head end section 14.

In the illustrated embodiment, the resonators 13 (e.g., 13A, 13B, 13C, and 13D) are coupled to at least one of the walls defining the boundary of the combustor 12. For example, the resonator 13A is coupled to the wall 35 disposed about the head end chamber 33, the resonator 13B is coupled to the wall 35 disposed about the head end chamber 33 and/or flow path 35 at a transition region between the combustor section 15 and the head end section 14, and the resonators 13C and 13D are coupled to the wall 35 disposed the flow path 35, the first wall 34, and the combustion chamber 17 of the combustor section 15. Furthermore, as illustrated in FIG. 1, the resonators 13 are arranged at different axial positions along an axial length 36 of the combustors 12, such as proximate to a first (e.g., upstream) axial end 38, a second (e.g., downstream) axial end 40, or at various intermediate positions between the first and second axial ends 38 and 40. However, in other embodiments, the resonators 13 may not be arranged along the axial length 36 of the combustors 12. For example, the resonators 13 may be positioned only near the first axial end 38 and/or the head end section 14 to attenuate resonance frequencies in close proximity to (e.g., directly upstream from) the fuel nozzles 16 and the entry of fuel and oxidant into the combustion chamber 17 of the combustor 12. For example, in certain embodiments, the resonators 13 (e.g., resonators 13A) may be positioned proximate to, axially upstream of, and/or axially overlapping with the fuel nozzles 16. The resonators 13 also may be spaced apart from one another at different radial positions, different circumferential positions, different axial positions, or any combination thereof. In the illustrated embodiment, the resonators 13 are configured to attenuate resonance of the fluid flows from the air intake 30, e.g., after passing through the compressor 28.

The turbine system 10 also may have a variety of monitoring and control equipment associated with the resonators 13 of the resonance attenuation system 11. In the illustrated embodiment, the turbine system 10 may include one or more sensors 48 to monitor the combustion process, oxidant flow, fuel flow, turbine speed, compressor feed, combustor temperature, combustion dynamics, acoustic noise, or a variety of other parameters of operation of the turbine system 10. For example, one or more vibration sensors 50 may be positioned on the combustors 12 between the one or more resonators 13. The vibration sensors 50 may detect vibrations within the combustors 12. For example, vibration above a set value level may provide an indication that tuning the resonators 13 may provide improved combustion characteristics. As will be described below, in certain embodiments, the resonators 13 may be adjustable to enable tuning before, during, and/or after operation (e.g., during maintenance) of the gas turbine system 10.

The sensors 48, 50 may be configured to send signals to a controller 52 (e.g., an electronic controller). In the illustrated embodiment, the controller 52 includes a memory 54 and a processor 56. The memory 54 may be a mass storage device, a FLASH memory device, removable memory, or any other non-transitory computer-readable medium (e.g., not only a signal). Additionally and/or alternatively, the instructions may be stored in an additional suitable article of manufacture that includes at least one tangible, non-transitory computer-readable medium that at least collectively stores these instructions or routines in a manner similar to the memory 54 as described above. The controller 52 may be configured to receive signals from the sensors 48, 50 indicative of operating parameters of the gas turbine system 10 (e.g., temperature, pressure, fuel/air ratio, acoustics, vibration). The signals may be evaluated by the processor 56 utilizing instructions stored on the memory 54. Additionally, the controller 52 may send signals to various components of the gas turbine system 10 (e.g., the resonators 13, the air intake 30, the combustor 12, etc.) to adjust operating conditions of the gas turbine system 10 (e.g., including adjustments to the resonators 13) based on the signals received from the sensors 48, 50.

Figure 2:
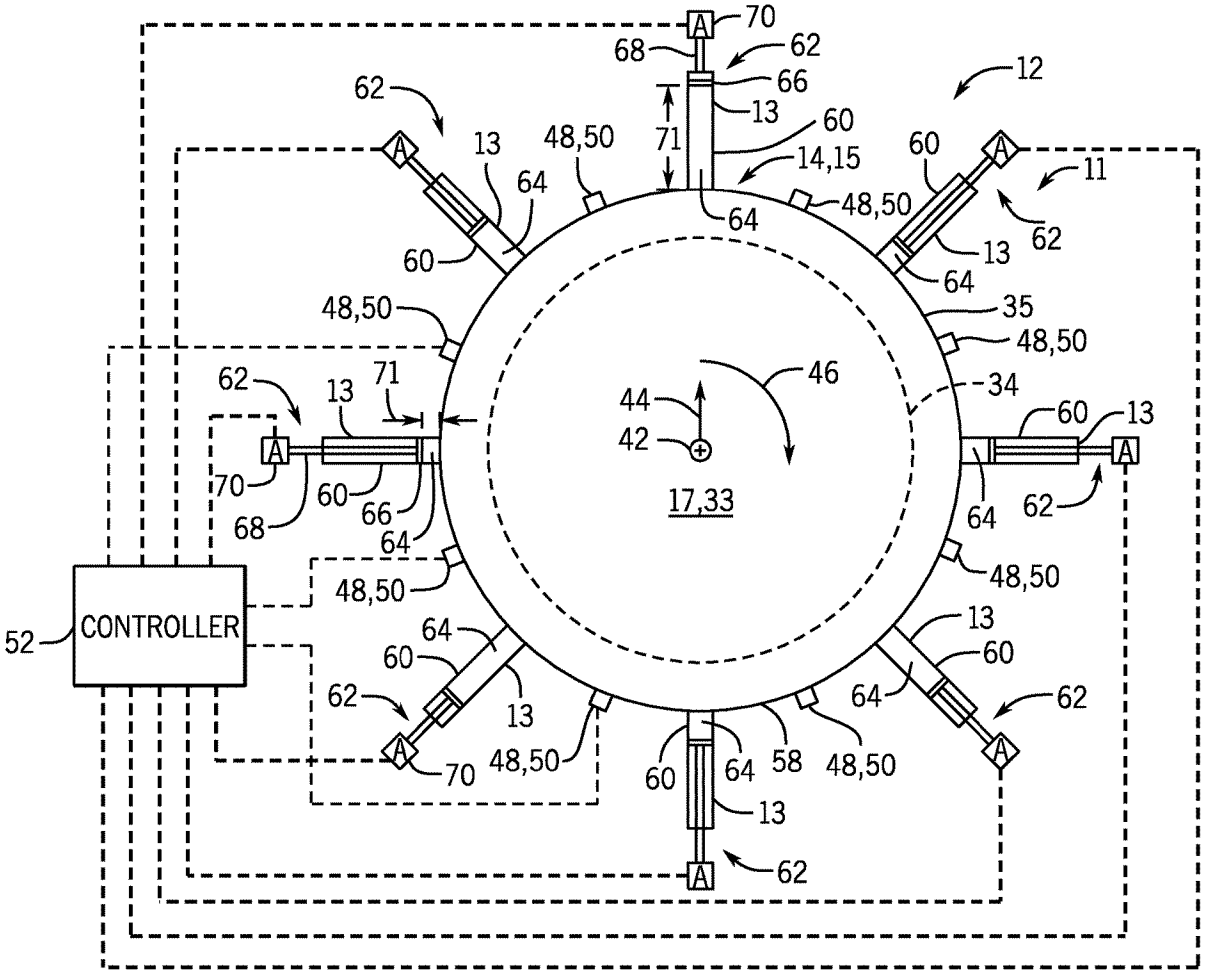
FIG. 2 is a radial cross-sectional schematic view of an embodiment of a combustor having the resonance attenuation system with a plurality of resonators (e.g., adjustable resonators)

FIG. 2 is a schematic radial cross-sectional view of an embodiment of the combustor 12 having resonators 13 disposed circumferentially 46 about the wall 35 of the combustor 12. In the illustrated embodiment, eight resonators 13 are positioned substantially symmetrically (e.g., within approximately plus or minus 15 degrees) along a circumference 58 of the combustor 12. However, in other embodiments, more of few resonators 13 may be included circumferentially 46 about the wall 35. For example, 1, 2, 3, 4, 5, 6, 7, 9, 10, 15, 20, 30, 40, 50 or any suitable number of resonators 13 (e.g., 1 to 100) may be positioned on the combustor 12. Moreover, the resonators 13 may be positioned at different locations along the circumference 58 of the combustor 12. For example, certain operating conditions may develop increased vibrations on one side of the combustor 12. As a result, more resonators 13 may be placed on the side having increased vibrations to attenuate the air flow. As mentioned above, the vibration sensors 50 may be communicatively coupled to the controller 52 to send signals indicative of the operation of the combustor 12. Moreover, in the illustrated embodiment, the resonators 13 are communicatively coupled to the controller 52. As will be described below, the controller 52 may instruct the resonators 13 to adjust before, during, and/or after operation to tune the combustor 12.

During operation, the resonators 13 are configured to receive a portion of the air flow from the air intake 30 and direct the portion of the air flow into the body of the resonators 13. For example, in the illustrated embodiment, each resonator 13 includes a resonator tube 60 and an adjustment mechanism 62 (e.g., frequency adjuster) to vary a resonator chamber 64 in the tube 60, thereby adjusting an attenuation frequency of the resonator 13. The adjustment mechanism 62 may include a plunger or piston 66 disposed in the tube 60, a drive shaft or rod 68 coupled to the piston 66, and an actuator 70 coupled to the rod 68. Each actuator 70 is in turn coupled to, and controlled by, the controller 52. The tube 60 may be a hollow cylindrical tube defining a cylinder, while the piston 66 may be a cylindrical piston. However, the tube 60 and piston 66 may have other shapes. The piston 66 also may include one or more seals (e.g., annular seal rings) to seal against an inner wall of the tube 60. The actuator 70 is configured to drive movement of the rod 68, which in turn drives movement of the piston 66 in the tube 60. The actuator 70 may include a manual actuator, such as a hand wheel, a crank lever, a tool interface (e.g., a bolt head that interfaces with a wrench), or any other suitable manual actuation feature. The actuator 70 also may include a powered actuator, such as an electric drive or motor, a pneumatic drive, a hydraulic drive, or any combination thereof. The actuator 70 (e.g., manual, powered, or both) may cause rotation and/or axial movement of the rod 68, which in turn causes axial movement of the piston 66 to vary an attenuation length 71 of the resonator chamber 64 within the tube 60 between the piston 66 and an open inner end portion along the wall 35 of the combustor 12.

As illustrated, the attenuation length 71 of the resonator chamber 64 varies from one resonator 13 to another about the circumference 58 of the wall 35 of the combustor 12. The attenuation length 71 of the resonator chamber 64 of each of the resonators 13 is particularly selected to attenuate (e.g., tune) a particular frequency or range of frequencies of the portion of the air flow from the air intake 30. Accordingly, as shown in the illustrated embodiment, the resonators 13 may have different attenuation lengths to attenuate different frequencies. However, in the illustrated embodiment, an overall length and diameter of each tube 60 may be constant (or uniform) among all of the resonators 13, thereby enabling simplified construction of the resonator 13 while still enabling attenuation of different frequencies for the combustor 12. As a result, similar parts may be utilized to manufacture and service the resonators 13. Moreover, the resonators 13 may be utilized over a larger range of frequencies due to their adjustability, thereby increasing their utility as conditions and resonance frequencies change in the gas turbine system 10.

Figure 3:
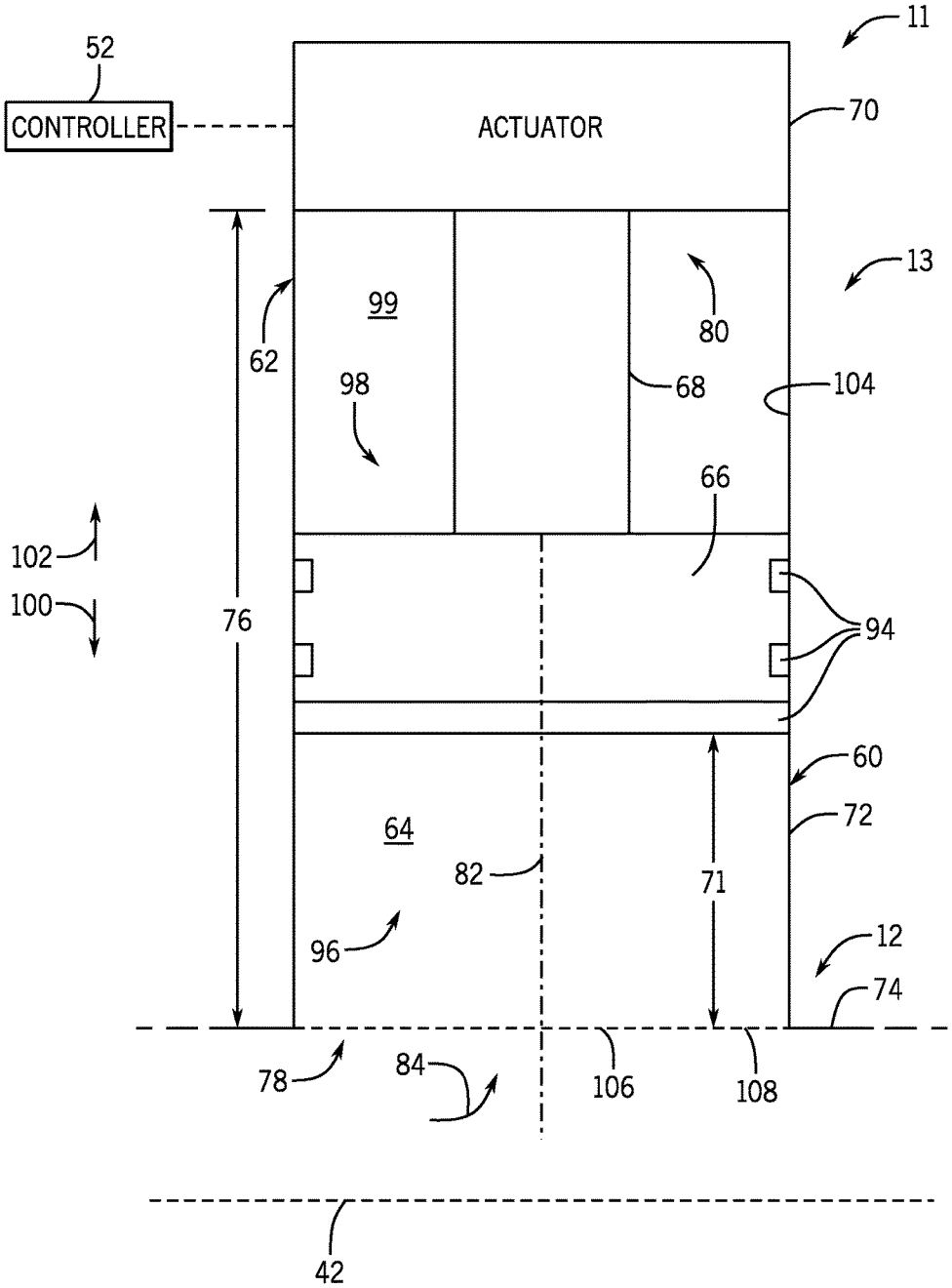
FIG. 3 is an axial cross-sectional view of an embodiment of an adjustable resonator having an adjustment mechanism.

FIG. 3 is an axial cross-sectional side view of an embodiment of the resonator 13 having an adjustment mechanism 62. In the illustrated embodiment, the tube 60 of the resonator 13 includes a cylinder defined by a generally cylindrical wall 72. However, in other embodiments, the wall 72 may be elliptical, polygonal, or the like. The wall 72 may be configured to couple to a sidewall 74 of the combustor 12, such as the wall 35 illustrated in FIGS. 1 and 2. For example, the wall 72 may include threads that engage mating threads in the sidewall 74, thereby coupling the resonator 13 to the combustor 12. However, in other embodiments, the wall 72 may be welded, bolted, clamped, or otherwise coupled to the sidewall 74 with a removable coupling or a fixed coupling. In some embodiments, the wall 72 of the tube 60 may be integrally formed as one-piece with the sidewall 74 of the combustor 12.

In the illustrated embodiment, the resonator 13 has a body length 76, e.g., a total length of the tube 60, extending from a first axial end 78 (e.g., end opening or face) to a second axial end 80 (e.g., end opening, sealed end, or face) along a resonator longitudinal axis 82. In the illustrated embodiment, the resonator longitudinal axis 82 is perpendicular or substantially perpendicular (e.g., 90 degrees plus or minus 1, 2, 3, 4, 5, 6, 7, 8, 9, or 10 degrees) relative to the longitudinal axis 42 of the combustor 12. However, in other embodiments, the resonator longitudinal axis 82 may be positioned crosswise at an angle (e.g., 10 to 80, 20 to 70, 30 to 60, or 40 to 50 degrees) relative to the longitudinal axis 42. In operation, the first axial end 78 (e.g., end opening) of the tube 60 receives a gas flow 84 (e.g., oxidant such as air, EGR gas, steam, inert gas such as nitrogen, gaseous fuel, fuel/air mixtures, etc.) from a fluid supply directed to the combustor 12 and directs the gas flow 84 into the resonator 13. In certain embodiments, the gas flow 84 excludes combustion gases directly from the combustion chamber 17, but may include any fluid flows directed into the combustion chamber 17 such as through the head end section 14. In other embodiments, the gas flow 84 may include the combustion gases directly from the combustion chamber 17. However, in the illustrated embodiment, the gas flow 84 may include at least a substantial amount (e.g., greater than 50, 60, 70, 80, 90, or 95 percent by volume) oxidant flow from the air intake 30, e.g., after compression by the compressor 28. As mentioned above, the resonator 13 is configured to reduce resonance in the combustion system by attenuating any resonance frequencies in the gas flow 84. In the illustrated embodiment, the frequency at which the resonator 13 attenuates the gas flow 84 is directly related to the attenuation length 71 of the resonator 13. The attenuation length 71 represents the distance that the gas flow 84 may travel through the resonator 13 before being reflected back toward the combustor 12. In other words, the attenuate length 86 is the distance between the first axial end 78 and the piston 66 in the tube 60 of the resonator 13. In certain embodiments, the attenuation length 71 may be varied continuously and/or incrementally (e.g., in incremental steps) between 0 and 100, 5 and 95, 10 and 90, 15 and 85, and 20 and 80 percent of the body length 76. For example, the attenuation length 71 may be varied in incremental steps of approximately 1, 2, 3, 4, 5, 6, 7, 8, 9, or 10 percent of the total body length 76 of the tube 60. As will be described below, the attenuation length 71 of the resonator 13 may be adjusted to enable attenuation over a range of frequencies.

Because it may be desirable to attenuate a range of frequencies in the combustor 12, the adjustment mechanism 62 (e.g., piston 66, rod 68, and actuator 70) is configured to adjust the attenuation length 71 of the resonator 13. In the illustrated embodiment, the adjustment mechanism 62 includes the piston 66, the rod 68, and the actuator 70. For example, the actuator 70 may include a drive or motor (e.g., electric, pneumatic, and/or hydraulic) that drives the rod 68 to change an axial position of the piston 66 along the resonator longitudinal axis 82. As a result, the piston 66 in the tube 60 of the resonator 13 has a different axial position, thereby adjusting the attenuation length 71. In the illustrated embodiment, the piston 66 includes seals 94 (e.g., annular seal rings) configured to fluidly isolate an active section 96 (e.g., resonator chamber 64) from an inactive section 98 (e.g., opposing chamber 99). The active section 96 may receive the gas flow 84, while the inactive section 98 may not receive the gas flow 84 due to blockage provided by the piston 66 and sealing provided by the seals 94.

The adjustment mechanism 62 may adjust the attenuation length 71, and therefore respective volumes of the active section 96 and the inactive section 98, via the actuator 70 driving axial motion of the piston 66 along the resonator longitudinal axis 82. That is, the adjustment mechanism 62 may drive movement of the piston 66 in a first direction 100 radially inward toward the longitudinal axis 42 of the combustor 12 or in a second direction 102 radially outward away from the longitudinal axis 42 of the combustor 12. For example, the actuator 70 may cause axial translation (i.e., axial movement without rotation) of the rod 68, thereby driving axial translation of the piston 66 in the tube 60. By further example, the actuator may cause rotation (with or without axial movement) of the rod 68, thereby driving axial movement of the piston 66 in the tube 60 (e.g., by threading the rod 68 through a threaded receptacle in the piston 66 while the piston 66 is blocked from rotating via an axial guide feature). By further example, the actuator 70 may drive rotation of the piston 66 to engage with corresponding threads, ridges, or gear teeth on an interior surface 104 of the wall 72, thereby causing the piston 66 to threadingly rotate and axially move along the wall 72 to change its axial position. Regardless of the specific configuration of the actuation mechanism 62, the piston 66 moves in the tube 60 to vary the attenuation length 71, thereby adjusting the resonator 13 to attenuate different frequencies without replacing the resonator 13. Moreover, the adjustment mechanism 62 may adjust the attenuation length 71 (e.g., via manual adjustments and/or control by the controller 52) during operation of the gas turbine system 10, thereby reducing system downtimes and enabling real-time or near real-time tuning of the gas turbine system 10.

In the illustrated embodiment, the resonator 13 includes a plate 106 at the first axial end 78. The plate 106 may include perforations 108 (e.g., orifices, openings, slots, etc.) to restrict and/or throttle the gas flow 84 entering the active section 96 of the resonator 13. For example, the plate 106 and the perforations 108 may decrease the cross-sectional area of openings through the first axial end 78, thereby reducing the gas flow 84 entering the active section 96. Moreover, the perforations 108 in the plate 106 enable viscous damping of the gas flow 84 entering the resonator 13 by forcing the gas flow 84 through the perforations 108 before entering the resonator 13, resulting in a loss of energy to the gas flow 84. For example, the pressure of the gas flow 84 may decrease as the gas flow 84 enters the resonator 13 due to the pressure drop across the plate 106.

Figure 4:
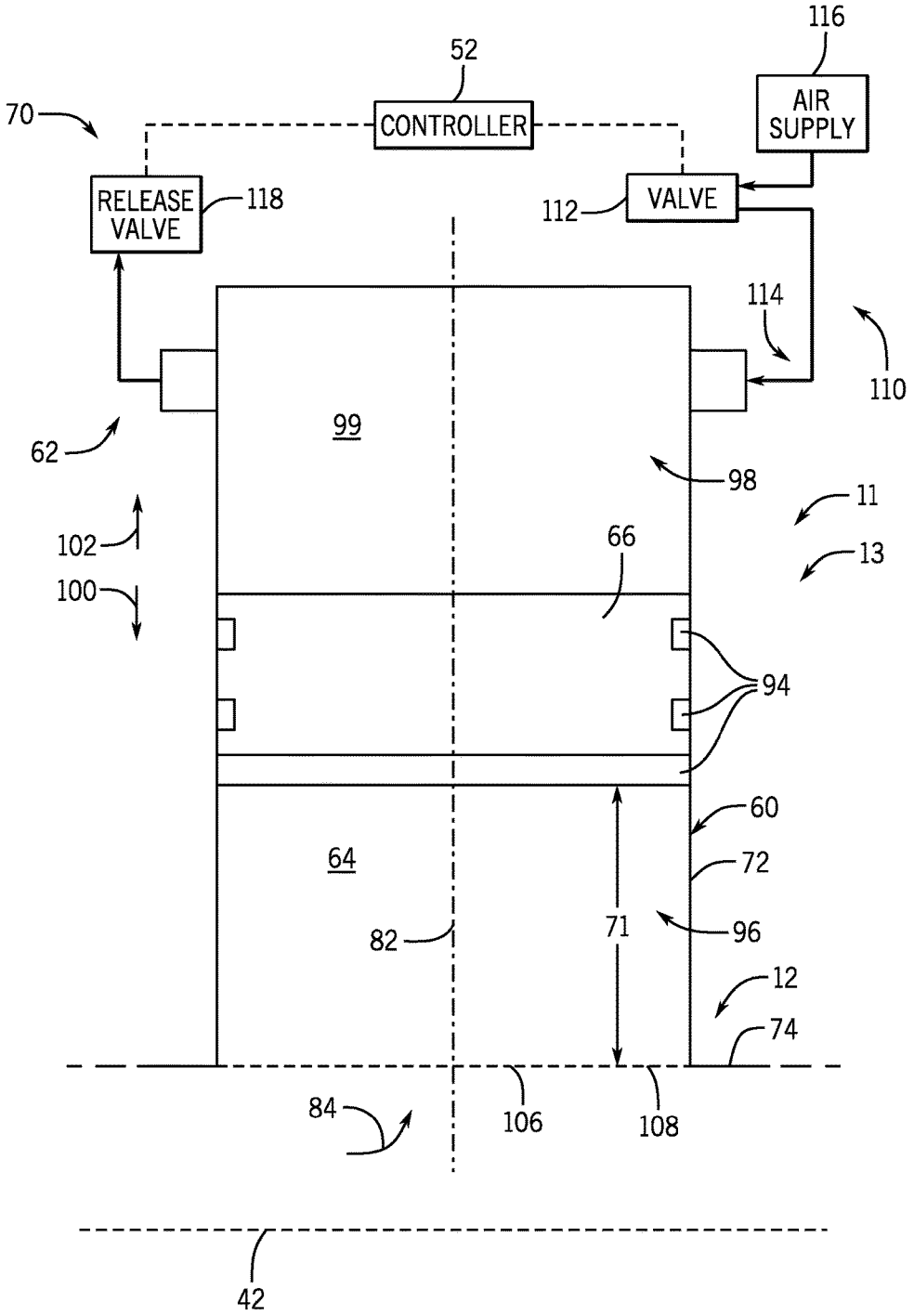
FIG. 4 is an axial cross-sectional view of an embodiment of an adjustable resonator having an adjustment mechanism.

FIG. 4 is an axial cross-sectional view of an embodiment of the adjustment mechanism 62 positioned on the resonator 13. In the illustrated embodiment, the adjustment mechanism 62 includes the piston 66 driven to move axially in the first direction 100 and the second direction 102 along the resonator longitudinal axis 82 via a pneumatic system 110 of the actuator 70. The pneumatic system 110 includes a control valve 112 configured to direct supply air 114 (or any other suitable gas) from an air supply system 116 (e.g., an instrument air system, the air intake 30, etc.) into the inactive section 98 (e.g., chamber 99). The pressure of the supply air 114 in the inactive section 98 may drive the piston 66 in the first direction 100, thereby decreasing the attenuation length 71 and reducing the volume of the active section 96. Additionally, a release valve 118 may be configured to selectively release the supply air 114 from the inactive section 98 (e.g., chamber 99) and enable movement of the piston 66 in the second direction 102, e.g., by enabling pressure of the gas flow 84 entering the resonator chamber 64 to overcome the pressure of gas (e.g., air) in the chamber 99. In the illustrated embodiment, the controller 52 may send a signal to the control valve 112 directing the control valve 112 to open and enable the supply air 114 to enter the inactive section 98. Moreover, the controller 52 may send a signal to the release valve 118 to direct the release valve 118 to open to reduce the pressure in the inactive section 98 to enable movement of the piston 66 in the second direction 102. Accordingly, the controller 52 may send signals to the control valve 112 and the release valve 118 to adjust the axial position of the piston 66. As a result, the resonator 13 may be tunable before, during, and/or after operation (e.g., during maintenance) of the gas turbine system 10 to adjust for changing operating conditions (e.g., fuel composition, ambient temperature, etc.), gradual degradation and wear on the gas turbine system 10, and various changes in resonance frequencies in the gas turbine system 10.

Figure 5:
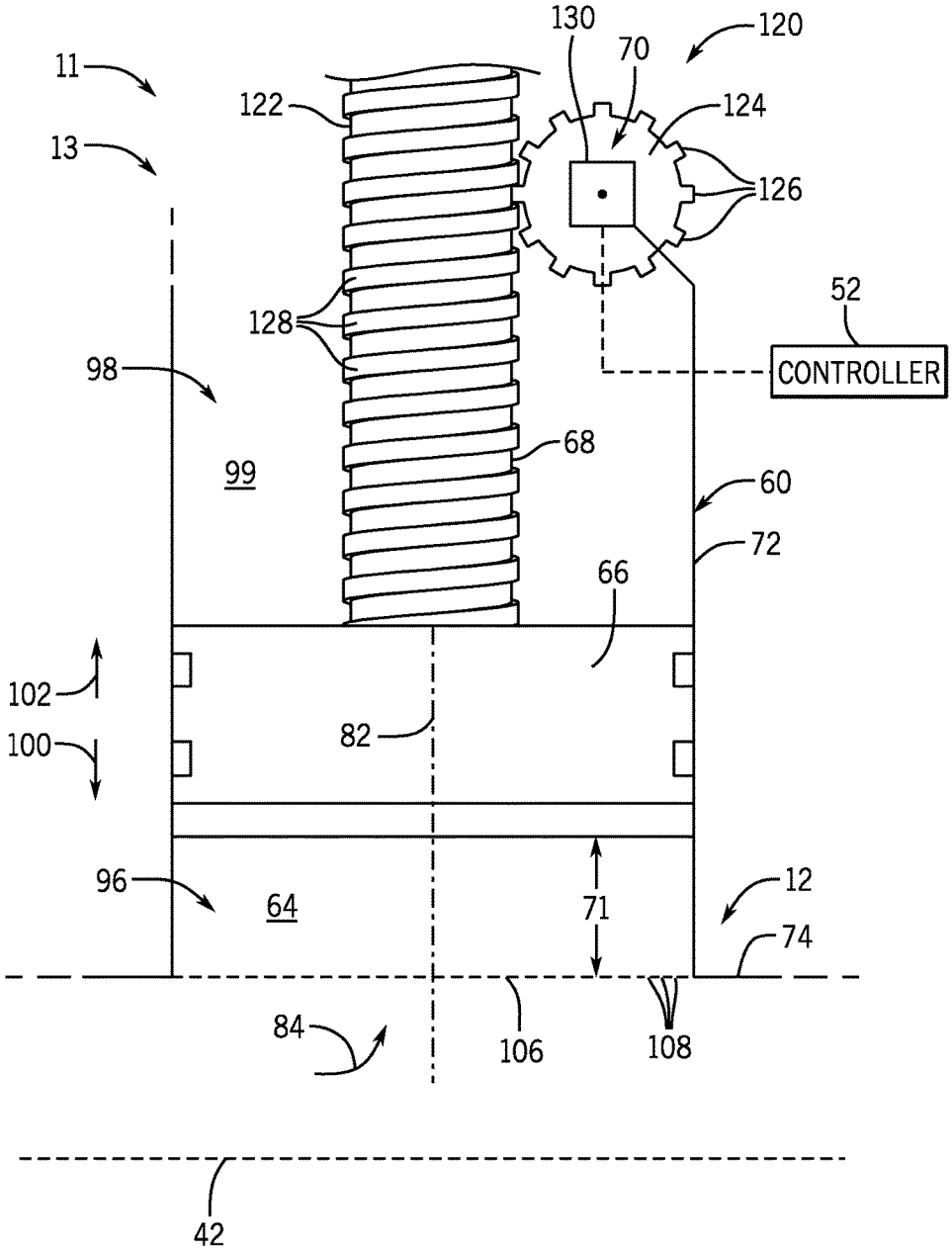
FIG. 5 is an axial cross-sectional view of an embodiment of an adjustable resonator having an adjustment mechanism.

FIG. 5 is an axial cross-sectional view of an embodiment of the adjustment mechanism 62 positioned on the resonator 13. In the illustrated embodiment, the adjustment mechanism 62 includes a gear set 120 having a first gear 122 (e.g., an elongated gear or geared shaft 68) interfacing with a second gear 124 (e.g., a circular gear). As the actuator 70 (e.g., a motor or drive 130) drives rotation of the second gear 124, gear teeth 126 of the second gear 124 engage with gear teeth 128 of the first gear 122 to transfer rotational movement of the second gear 124 into movement of the first gear 122, thereby driving the piston 66 to move along the tube 60 and vary the attenuation length 71.

For example, the gear set 120 may be a rack and pinion gear set, wherein the first gear 122 is a linear gear bar or rack and the second gear 124 is a circular gear or pinion. Accordingly, as the actuator 70 (e.g., a motor or drive 130) drives rotation of the pinion 124, gear teeth 126 of the pinion 124 engage with gear teeth (or threads) 128 of the rack 122 to transfer rotational movement of the pinion 124 into axial movement of the rack 122 and thus the piston 66.

By further example, the gear set 120 may be a worm gear set, wherein the first gear 122 is a worm (e.g., an elongated threaded worm shaft 68) and the second gear 124 is a worm gear. Accordingly, as the actuator 70 (e.g., a motor or drive 130) drives rotation of the worm gear 124, gear teeth 126 of the worm 124 engage with gear teeth (or threads) 128 of the worm 122 to transfer rotational movement of the worm gear 124 into movement of the worm 122 and thus the piston 66. For example, the worm gear 124 may drive rotation of the worm 122, which then rotates threads within a threaded bore in the piston 66 to cause axial movement of the piston 66, or rotates the piston 66 along a threaded interface along the interior surface 104, or another suitable arrangement. By further example, the worm gear 124 may drive axial movement of the worm 122, thereby driving axial movement of the piston 66.

As a result, the piston 66 may be moved in first and second directions 100, 102 in response to actuation of the gear set 120 by the actuator 70 (e.g., drive 130). Similar to the discussion above, the drive 130 may include an electric, pneumatic, and/or hydraulic drive or motor. As shown, the gear 124 may be coupled to the wall 72 of the resonator 13. However, in other embodiments, the gear 124 may include a separate housing coupled to the sidewall 74 of the combustor 12. As described above, the controller 52 may send a signal to the adjustment mechanism 62 instructing the adjustment mechanism 62 to change the attenuation length 71.

Figure 6:
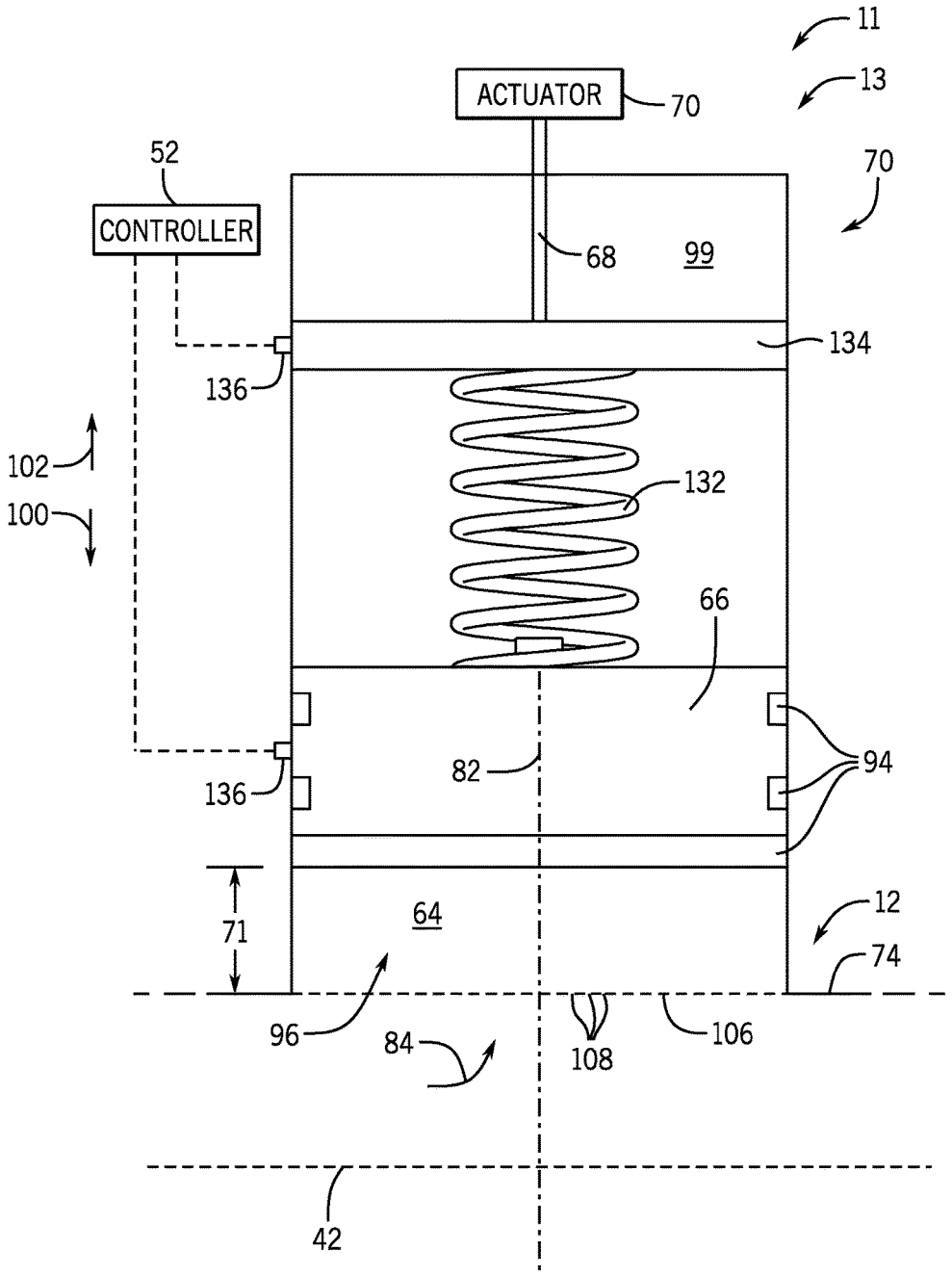
FIG. 6 is an axial cross-sectional view of an embodiment of an adjustable resonator having an adjustment mechanism.

FIG. 6 is an axial cross-sectional view of an embodiment of the adjustment mechanism 62 positioned on the resonator 13. In the illustrated embodiment, the adjustment mechanism includes a biasing member 132 (e.g., a mechanical spring, opposing magnets that magnetically repel one another, a compressible fluid, or any combination thereof) and a compression member 134 (e.g., a secondary piston). The biasing member 132 is configured to drive the piston 66 in the first direction 100, radially inward toward the longitudinal axis 42 of the combustor 12. In the illustrated embodiment, the biasing member 132 includes a spring having a spring constant configured to return a force substantially proportional to a change in length of the spring resulting from an opposing force. For example, the spring constant may be particularly selected to enable compression of the spring 132, and therefore movement of the piston 66 in the second direction 102, to form a particularly selected attenuation length 71 based on an anticipated operating pressure of the combustor 12. Additionally, the actuator 70 may be controlled to move the compression member 134 (e.g., moved to a different axial position) to pre-tension the biasing member 132, therefore limiting the total movement of the piston 66 (e.g., floating piston or spring biased piston) in the second direction 102. For example, the actuator 70 may be controlled to move the compression member 134 in the first direction 100 and/or the second direction 102 to modify the volume of the inactive section 98. As a result, the attenuation length 71 may be controlled by the position of the compression member 134, the spring constant of the biasing member 132, and/or the operating pressure of the combustor 12. In certain embodiments, the controller 52 may be communicatively coupled to the actuator 70 to control movement of the compression member 134, and the controller 52 may be coupled to one or more sensors 136 associated with the compression member 134, the piston 66, or both. For example, the sensors 136 may monitor pressures in the chambers 64 and/or 99, positions of the compression member 134 and/or the piston 66, or any combination thereof. The position and/or pressure feedback may enable the controller 52 to more accurately control the position of compression member 134 and/or the piston 66 via the actuator 70.

Figure 7:
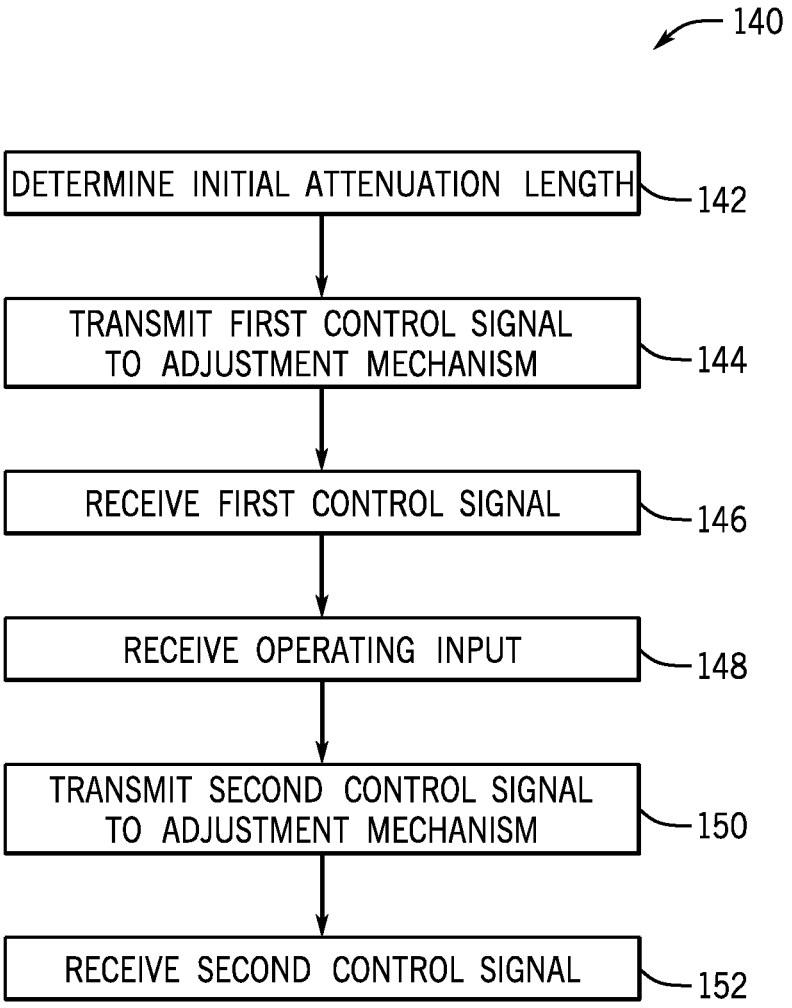
FIG. 7 is a flow chart of an embodiment of a method for adjusting an attenuation length of an adjustable resonator.

FIG. 7 is a flow chart of an embodiment of a method 140 for controlling the attenuation length 71 of the resonators 13. As mentioned above, the attenuation length 71 of the resonator 13 may be changed to adjust the frequency attenuated by the resonator 13. As a result, different frequencies of the gas flow 84 flowing into the resonators 13 via the first axial end 78 (e.g., open end) may be attenuated before, during, and/or after operation of the gas turbine system 10. An initial attenuation length 71 is determined at block 142. For example, the initial attenuation length 71 may be particularly selected based on anticipated operating conditions and/or frequencies of the gas flow 84 through the combustor 12. A first control signal is transmitted to the adjustment mechanism 62 from the controller 52 at block 144. For example, an operator may input pre-set initial attenuation lengths 71 based on previous operation cycles of the gas turbine system 10. The controller 52 may transmit the first control signal to the adjustment mechanism 62 to instruct the adjustment mechanism 62 to drive movement of the piston 66 to establish the initial attenuation length 71 within the resonator 13. The first control signal is received by the adjustment mechanism 62 at block 146. As described above, the adjustment mechanism 62 may be communicatively coupled to the controller 52 to enable the adjustment mechanism 62 to initiate instructions received from the controller 52. For example, upon receipt of instructions to set the piston 66 at the initial attenuation length 71, the actuator 70 of the adjustment mechanism 62 may drive the piston 66 in the first direction 100. The controller 52 may receive an operating input from the sensors 48, 50 at block 148. For example, the vibration sensor 50 may transmit a signal to the controller 52 indicative of an undesirable vibration in the combustor 12 (e.g., vibration in the fuel nozzle 16, vibration along the axial length 36 of the combustor 12, etc.). The controller 52 may transmit a second control signal to the adjustment mechanism 62 at block 150. For example, the second control signal may be an instruction to change the attenuation length 71 based on the signal received from the sensors 48, 50. The adjustment mechanism 62 may receive the second control signal at block 152. For example, the actuator 70 of the adjustment mechanism 62 may drive motion of the piston 66 in the second direction 102 to adjust the attenuation length 71 to an operating length, and thereby adjust the frequency that may be attenuated. As a result, the resonators 13 may be tuned before and/or during operation of the gas turbine system 10.

As described in detail above, the gas turbine system 10 may include resonators 13 positioned on the combustors 12 to attenuate frequencies in the gas flow 84 traveling through the combustors 12. For example, the resonators 13 may be positioned circumferentially along the circumferential axis 46 of the combustors 12 and/or axially along the axial length 36 of the combustors 12. In certain embodiments, the resonators 13 may be configured to attenuate the frequency of the gas flow 84 related to the attenuation length 71 of the resonators 13. For example, in certain embodiments, the resonators 13 may include the piston 66 configured to separate the resonators 13 into active sections 96 and inactive sections 98. The active sections 96 receive the gas flow 84, and the inactive sections 98 do not. Moreover, the piston 66 is movable along the resonator longitudinal axis 82 to enable adjustment of the attenuation length 71 before, during, and/or after operation of the combustors 12. For example, the resonators 13 may include the adjustment mechanisms 70 configured to drive movement of the piston 66 within the resonators 13, and thereby adjust the attenuation length 71. Furthermore, the adjustment mechanisms 70 may receive instructions from the controller 52 to set a desired attenuation length. Moreover, the attenuation length 71 may be adjusted based on operating parameters received from the sensors 48, 50 distributed throughout the gas turbine system 10. Accordingly, the combustors 12 may be tuned before, during, and/or after operation to stabilize emissions, reduce combustion dynamics, stabilize combustion conditions, or the like.

This written description uses examples to disclose various embodiments of the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

a combustor having a combustion chamber and a combustor supply passage configured to supply a fluid flow into the combustion chamber; and a plurality of resonators configured to receive at least a portion of the fluid flow, wherein each resonator of the plurality of resonators comprise a respective frequency adjuster configured to change an attenuation frequency of the resonator, wherein the plurality of resonators, comprise:

a piston;

a tube defining a resonator chamber, wherein the resonator chamber is configured to receive the piston, and wherein a maximum width of the tube extends to a combustor sidewall;

a plurality of actuators, wherein each piston couples to a respective actuator of the plurality of actuators to adjust a position of the piston in the resonator chamber to vary a size of the resonator chamber;

a plurality of vibration sensors configured to detect vibration; and a controller communicatively coupled to the actuator and configured to receive signals from the plurality of vibration sensors and in response control one or more of the plurality of the actuators to control one or more of the plurality of resonators to reduce vibration.

2. The system of claim 1, wherein the combustor comprises a gas turbine combustor.

3. The system of claim 2, comprising a gas turbine engine having the gas turbine combustor.

4. The system of claim 2, wherein the combustor supply passage comprises a head end chamber of the gas turbine combustor, a passage between a combustion liner and a flow sleeve, or a combination thereof.

5. The system of claim 1, wherein the fluid flow comprises an oxidant.

6. The system of claim 1, wherein the plurality of actuators comprise an electric drive, a pneumatic drive, a hydraulic drive, or a combination thereof.

7. The system of claim 1, wherein the plurality of resonators are circumferentially spaced around the combustor.

8. A system comprising:

a plurality of resonators configured to receive at least a portion of a fluid flow being supplied to a combustion chamber of a combustor, wherein the plurality of resonators comprise a respective frequency adjuster configured to change an attenuation frequency of each resonator of the plurality of resonators, and wherein one or more of the frequency adjusters comprises a piston disposed in a tube and an actuator configured to adjust a position of the piston in the tube to vary a size of a resonator chamber;

a plurality of vibration sensors configured to detect vibration at least partially caused by combustion in the combustor; and a controller comprising a memory operatively coupled to a processor configured to store data and instructions, wherein the controller is configured to receive signals from the plurality of vibration sensors and in response transmit instructions to one or more of the frequency adjusters to change the attenuation frequency of one or more of the plurality of resonators to reduce the vibration, and wherein the controller is communicatively coupled to the actuator.

9. The system of claim 8, comprising a sensor communicatively coupled to the controller, wherein the sensor sends a signal to the controller indicative of an operating parameter of a gas turbine system having the combustor and the plurality of resonators, and the controller is configured to instruct one or more of the frequency adjusters to change the attenuation frequency of one or more of the plurality of resonators based on the operating parameter.

10. A method comprising:

receiving one or more signals from one or more vibration sensors; and adjusting an attenuation frequency of one or more resonators of a plurality of resonators coupled to a combustor supply passage configured to supply a fluid flow into a combustion chamber of a combustor to reduce vibration at least partially caused by combustion in the combustor, wherein each resonator of the plurality of resonators is configured to receive at least a portion of the fluid flow, and wherein adjusting comprises actuating a piston disposed in a tube of one or more of the plurality of resonators with an actuator communicatively coupled to a controller.

11. The method of claim 10, wherein adjusting comprises responding to sensor feedback indicative of at least one operating parameter of a gas turbine system having the combustor and the plurality of resonators.

12. The method of claim 10, wherein the fluid flow comprises an oxidant flow being supplied to the combustion chamber of the combustor.

* * * * *